US006146506A

United States Patent [19]

Bauer et al.

[11] Patent Number: 6,146,506

[45] Date of Patent: Nov. 14, 2000

[54] FLUORINE CELL

[75] Inventors: Gerald L. Bauer, Hudson, Wis.; William Ves Childs, Stillwater, Minn.

[73] Assignee: 3M Innovative Properties Company, St. Paul, Minn.

[21] Appl. No.: 08/399,961

[22] Filed: Mar. 6, 1995

Related U.S. Application Data

[63] Continuation of application No. 08/117,232, Sep. 3, 1993, abandoned.

[51] Int. Cl.[7] ..... C25C 7/00; C25C 7/02

[52] U.S. Cl. ..... 204/247; 204/290 R; 204/294

[58] Field of Search ..... 204/242, 243 R, 204/246, 247, 290 R, 294, 280, 284, 243.1

[56] References Cited

U.S. PATENT DOCUMENTS

| | | | |
|---|---|---|---|
| 2,273,798 | 2/1942 | Heise et al. | 204/82 |
| 3,041,266 | 6/1962 | Cable et al. | 204/288 |
| 3,069,345 | 12/1962 | Lowdermilk et al. | 204/286 |
| 3,212,930 | 10/1965 | Thompson et al. | 117/213 |
| 3,395,049 | 7/1968 | Thompson | 136/122 |
| 3,655,535 | 4/1972 | Ruehlen et al. | 204/59 |
| 3,676,324 | 7/1972 | Mills | 204/288 |
| 3,692,660 | 9/1972 | MacMullin et al. | 204/246 |
| 3,708,416 | 1/1973 | Ruehlen et al. | 204/284 |
| 3,720,597 | 3/1973 | Ashe, Jr. et al. | 204/284 |
| 3,772,201 | 11/1973 | Mills | 204/246 |
| 3,773,644 | 11/1973 | Tricoli et al. | 204/252 |
| 4,139,447 | 2/1979 | Faron et al. | 204/239 |
| 4,312,718 | 1/1982 | Watanabe et al. | 204/60 |
| 4,474,613 | 10/1984 | Zollner | 204/286 |
| 4,491,653 | 1/1985 | McGinniss et al. | 525/356 |
| 4,511,440 | 4/1985 | Saproklin | 204/60 |
| 4,602,985 | 7/1986 | Hough et al. | 204/60 |
| 4,640,744 | 2/1987 | Howe | 204/1 |
| 4,915,809 | 4/1990 | Brown et al. | 204/243 |
| 4,950,370 | 8/1990 | Tarancon | 204/128 |

FOREIGN PATENT DOCUMENTS

| | | |
|---|---|---|
| 984 665 | 7/1951 | France . |
| 60-221591 | 11/1985 | Japan . |
| 2 135 334 | 8/1984 | United Kingdom . |
| 2 135 335 | 8/1984 | United Kingdom . |
| WO 90/06296 | 6/1990 | WIPO . |

OTHER PUBLICATIONS

Rudge, "The Manufacture and Use of Fluorine and Its Compounds," pp. 18–45, 82–83, Oxford University Press (1962) no month availble.

Childs et al., "Anodic Fluorination," Chapter 26 (pp. 1103–1127) of "Organic Electrochemistry: An Introduction and a Guide," 3rd ed. Marcell Dekker, Inc. no date available.

Schonhorn et al., "Surface Treatment of Polymers. II. Effectiveness of Fluorination as a Surface Treatment of Polyethylene," J. of Appl. Polym. Schi., vol. 12, pp. 1231–1237 (1968) no month availabe.

Techniques of Chemistry, "Technique of Electroorganic Synthesis," The Phillips Electrochemical Fluorination Proc., Chap. 7, pp. 341–381 (John Wiley & Sons, 1982) no month availabe.

*Primary Examiner*—Kathryn Gorgos
*Attorney, Agent, or Firm*—Carolyn V. Peters

[57] ABSTRACT

An electrochemical cell for the production of fluorine includes an anode having a carbon portion partially or fully impregnated with a polymeric material and a conductive centrally disposed internal channel that permits the anode to be run at high current with uniform current densities without undue resistance heating.

20 Claims, 3 Drawing Sheets

FLUORINE CELL

This is a continuation of application Ser. No. 08/117,232 filed Sep. 3, 1993, now abandoned.

TECHNICAL FIELD

The invention relates to electrochemical cells and in particular to electrochemical cells utilizing improved carbon anodes for generation of elemental fluorine.

BACKGROUND OF THE INVENTION

Electrochemical cells used to generate fluorine gas generally include an anode, a cathode, an electrolyte, an electrolyte-resistant container, and a gas separator. Anodes are typically fabricated from amorphous, nongraphitic carbon. Cathodes are typically fabricated from mild steel, nickel, or Monel™ alloy. Electrolyte is generally KF·2HF containing approximately 39 to 42% hydrogen fluoride. Gas separators segregate the generated hydrogen (formed at the cathode) from the generated fluorine (formed at the anode) thereby avoiding spontaneous, and often violent, hydrogen fluoride reformation.

Electrochemical cells of this general type are described in Rudge, *The Manufacture and Use of Fluorine and Its Compounds,* 1845, 82–83 (Oxford University Press, 1962).

The upper portion of a carbon anode is typically connected through a metal connection to a current source. This metal/carbon junction can be corroded during cell operation and the extent and speed of corrosion can depend on the location of the metal/carbon junction. For example, in some cells, the metal/carbon junction is within the cell housing but not immersed in the electrolyte. Other cells are arranged such that the metal/carbon junction is within the cell housing and also immersed in the electrolyte. In still other configurations, the metal/carbon junction is removed completely from the cell housing and is situated above the cell cover. See, e.g. U.S. Pat. No. 3,773,644.

Within the teachings of the conventional art, the limit of the current density at which anodes can be operated satisfactorily is a principal constraint in optimizing cell operations. Conventional fluorine cells are typically operated at anodic current densities of 80 to 150 ma/cm$^2$. One difficulty associated with attempting to run conventional fluorine cells at higher current densities is that carbon is a relatively poor conductor, particularly when compared to many metals. This-leads to resistance heating when substantial current is passed through the carbon. If this resistance heating produces more heat than can be dissipated, the carbon temperature will be elevated and the carbon will react with elemental fluorine. This reaction is significant whenever the temperature exceeds about 150° C. This reaction will eventually result in the destruction of the carbon portion by burning or by converting it to a doughy state often noted in the art. Resistance heating is also a concern at the carbon/metal interface where it can lead to higher temperatures and enhanced corrosion.

Resistance heating in carbon anodes can be reduced or eliminated by including a metal conductor that extends into the anode (See for example, U.S. Pat. Nos. 3,655,535, 3,676,324, and 4,511,440 and GB Patent No. 2 135 335 A). Copper, for example, has a conductivity of 4000 times that of carbon, and a copper insert of sufficient cross section extending a substantial distance into the anode can carry the entire anode current with no significant generation of heat.

Resistance heating also accelerates the corrosion at the metal-carbon junction. The attack on the carbon and the corrosion at the junction increase the resistance in the anode and junction. Such an increase in resistance increases the resistance heating in the anode and junction. The result is a monotonic increase in resistance heating and temperature and attack on the anode and carbon-metal interface.

Many metals, including copper and nickel, will corrode (through the well-known mechanism of bimetallic corrosion (an electrochemical phenomenon) when they are in contact with another metal, or carbon, and an electrolyte, such as KF-2HF. When a carbon anode with an interior metal conductor is used, molten KF-2HF will eventually penetrate through the pores of the carbon to contact the interior metal conductor and cause the metal to corrode through bimetallic corrosion. This electrolyte penetration will occur, at immersions greater than about ten cm, through the pores present in ordinary dense carbon or through the pores of carbon especially made to be porous. Such corrosion at the carbon-metal interface will cause an increase in resistance (as stated above) at this interface. This increase in resistance at this interface will lead to increased resistance heating at the interface and to an increased corrosion rate. Furthermore, the corrosion products from the metal occupy more volume than did the original metal. This increased volume leads to pressure against the carbon anode and eventually causes the carbon to break.

SUMMARY OF THE INVENTION

In one aspect, an electrochemical cell for the production of fluorine is provided comprising (1) a cell housing, (2) KF·2HF electrolyte, (3) at least two electrodes, wherein one electrode is a cathode, and the other electrode is an anode having a centrally disposed interior metal conductor positioned within the cell housing such that the interior metal conductor extends from the top of the carbon portion to below the electrolyte level, typically to no more than 10 cm below the surface of the electrolyte, (4) a means for passing current current into the anode (which serves as an electron sink) through the electrolyte, and into the cathode (which serves as an electron source), and (5) means for separately collecting the generated gases, hydrogen from the cathode and fluorine from the anode.

Advantageously, extending the centrally-located interior metal conductor from the top of the carbon anode to below the electrolyte level surprisingly provides protection against degradation (by thermally promoted reaction of the carbon with fluorine gas) of the carbon anode above the electrolyte level. If the interior metal conductor extends to no more than about 10 cm below the electrolyte level, corrosion at the carbon-metal interface is substantially less than if said conductor extends to more than about 10 cm below the electrolyte level.

In another aspect of the present invention, an electrochemical cell is provided comprising (1) a cell housing, (2) KF·2HF electrolyte, (3) at least two electrodes, wherein one electrode is a cathode, and the other electrode is an anode, partially or fully impregnated with a polymeric material, having a centrally disposed interior conductor positioned within the cell housing such that the interior conductor extends from the top of the carbon portion to a point below the electrolyte level, (4) a means to supply a suitable current flow through the electrodes, and (5) means for separately collecting the generated gases, hydrogen from the cathode and fluorine from the anode. Often, in smaller anodes, the interior conductor may only extend from the top of the carbon portion to approximately 50% of the distance between the electrolyte level and the bottom of the carbon portion. Preferably, and especially with larger anodes (those that operate in excess of 100 amperes), the interior conductor will extend from the top of the carbon portion to approximately one carbon portion radius from the bottom of the carbon portion.

Advantageously, the carbon portion of the anode is either partially or fully impregnated with a polymeric material that inhibits electrolyte and fluorine penetration into the carbon portion. By not allowing the electrolyte and fluorine to penetrate the carbon and to reach the metal conductor, corrosion of the interior metal conductor can be avoided, even after extended periods of use. Furthermore, the protection of the interior conductor from corrosion permits the use of an essentially full length conductor, which in turn permits the use of higher currents and provides a substantially uniform current density along the length of the carbon portion. Preferred polymeric materials include styrene-divinyl benzene copolymers and epoxies.

In another aspect, a carbon anode for use in electrochemical fluorine cells is provided. It is fabricated from a substantially cylindrical piece of carbon with the lateral surfaces of the cylinder being the principal anodic surfaces.

Alternatively, the carbon anode can be fabricated from a rectangular prism with the lateral surfaces of the prisms being the principal anodic surfaces. The prism will generally have a vertical dimension, a major horizontal dimension and a minor horizontal dimension.

Both carbon anodes (substantially cylindrical or rectangularly shaped) may include at least one interior channel extending from the top of the carbon portion to within about one carbon portion radius from the bottom of the carbon portion. In the case of the rectangularly shaped anode, the interior channel can extend to within about one-half of the minor horizontal dimension. The channel can contain an interior metal conductor that preferably is a metal coating on the surface of the channel or a metal tube or rod. Preferably, the interior metal conductor is of a length that it extends from about the top of the carbon portion to the bottom or terminus of the interior channel.

In yet another aspect, an electrochemical cell for generating fluorine is provided in which the carbon/metal junction area at the upper portion of the carbon anode is protected from fluorine and hydrogen fluoride vapors. The cell may further include a first gas separator that keeps fluorine gas generated by the anode and the hydrogen gas generated by the cathode separated in separate volumes in the cell above the electrolyte. The cell may also include a second gas separator positioned between the first gas separator and the anode. The second gas separator is shorter than the first gas separator and does not extend into the electrolyte. An inert gas source supplies an inert gas to the space between the second gas separator and the anode. The source provides a flow of the inert gas between the second gas separator and the anode such that fluorine and hydrogen fluoride vapors (designated by arrows 17*a*) entering into the space above the electrolyte are forced between the first and second separators. As a result, the contact between the fluorine and hydrogen fluoride vapors and the carbon/metal junction of the sleeve/hanger combination and the carbon anode is minimized.

As used in this application:

"anode" means the surface of a conductor acting to sink electrons from the electrolyte, and also refers to the anode assembly comprising a carbon portion (will have an anodic surface when current is applied) and a current carrier;

"anode assembly" is used to designate all the elements making up the electrode and includes the upper flange, the appropriate inlets and outlets, electrical connections, the anode hanger, sleeves and compression means, inner, outer and perforated gas separators, internal conductors, internal channels, external vertical grooves and the like;

"carbon anode" is used to designate the carbon portion of the anode assembly;

"fully impregnated" means a carbon portion impregnated with a polymeric material such that essentially all the pores are filled with the polymeric material and the internal conductor is effectively protected from the electrolyte and fluorine;

"partially impregnated" means a carbon portion impregnated with a polymeric material such that all the pores may not be completely filled with the polymeric material, but a sufficient number of pores are filled so the internal conductor is effectively protected from the electrolyte and fluorine;

"metal conductor" means a metal-containing material and may be a solid metal, metal turnings packed into a space and impregnated with a polymer, metal spheres or spheroids or other solids shapes packed into a space and impregnated with a polymer and other suitable configurations provided the metal conductor has a conductivity of at least 2500 $\Omega^{-1}\cdot cm^{-1}$, and preferably at least 100,000 $\Omega^{-1}\cdot cm^{-1}$ or resistivity of <400 $\mu\Omega\cdot$cm, preferably <10 $\mu\Omega\cdot$cm, more preferably <2 $\mu\Omega\cdot$cm; and "operating at high current density" means operating for at least forty-eight consecutive hours at a mean current density of at least 200 ma/cm$^2$ without the interior temperature of the anode exceeding 180° C., preferably not exceeding 150° C. The interior anode temperature may be measured at about the electrolyte level and about 0.1 to 0.3 carbon piece diameters in from the lateral surface of the anode.

DESCRIPTION OF THE PREFERRED EMBODIMENT(S)

Electrochemical Cell

Figure 1:
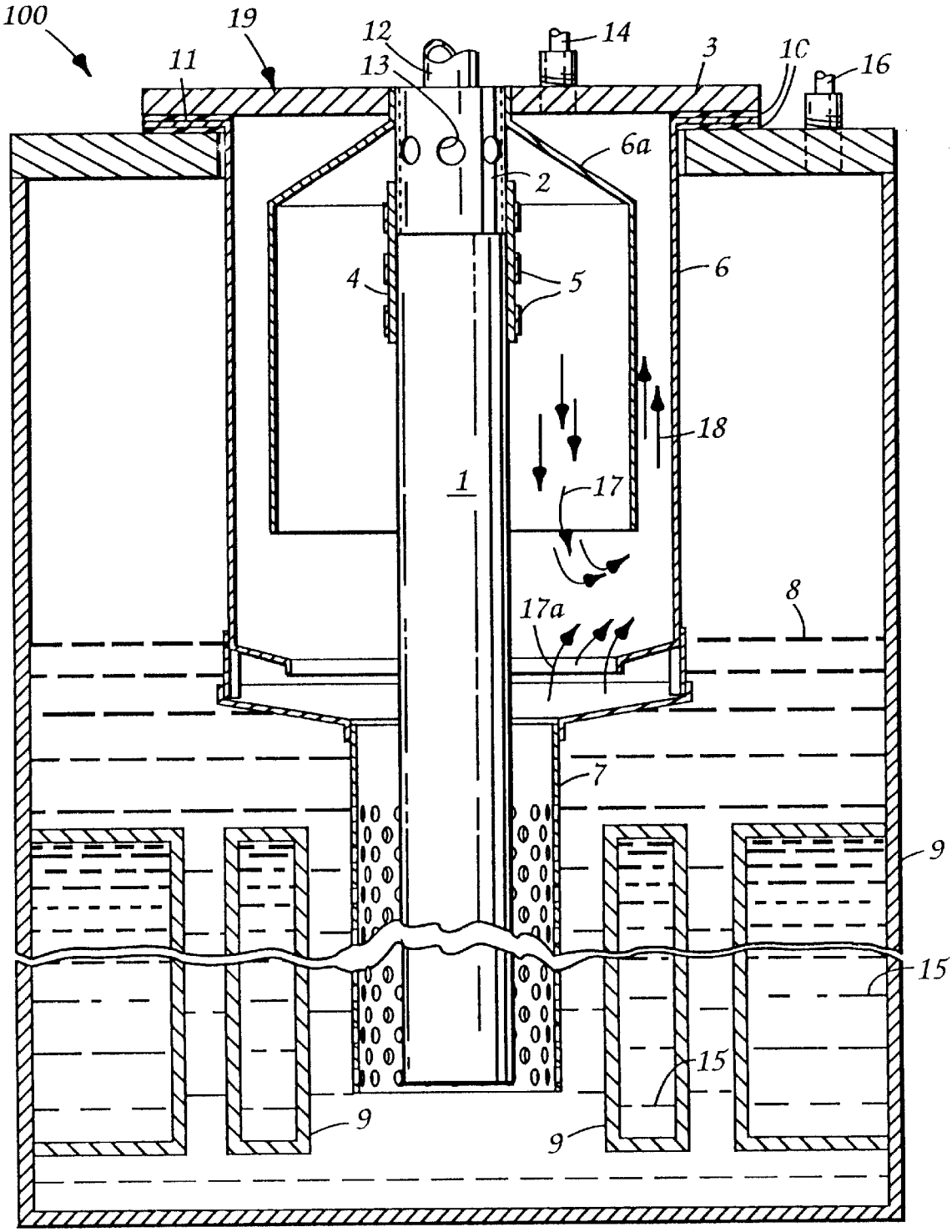
FIG. 1 is a cross-sectional view of an electrochemical cell of the invention.

Referring to FIG. 1, an electrochemical cell (100) for generating fluorine includes a cell housing (9), which can also function as the cathode and as a heat exchange surface for controlling the cell temperature, molten KF·2HF electrolyte (8), and an anode assembly (19). Preferably, the electrochemical cell (100) is a callandria cell and the general structure of such a callandria cell is described in U.S. Pat. No. 3,692,660 and such description is incorporated herein by reference.

Cell Housing

Conveniently, the cell housing is a vertically disposed callandria, or shell and tube design as described in U.S. Pat. No. 3,692,660 as incorporated above. It is typically constructed of ordinary mild steel resistant to hydrogen embrittlement such as, MONEL nickel, nickel, or other metals or alloys suitably resistant to the KF·2HF electrolyte. The electrolyte is contained in the tube side of the callandria and is circulated by gas lift provided by the gases generated at the electrodes. This gas lift will cause the electrolyte to rise in the tubes occupied by the anodes and to fall in the downcomer tubes. A suitably tempered heat exchange fluid can be circulated through the shell side of the callendria to maintain the electrolyte temperature and to reject heat generated by the passage of current through the electrodes and electrolyte. Furthermore, the electrochemical cell can be configured such that the cell housing also functions as a cathode surface.

Cathode

Cathodes are typically metal plates mounted in the cell facing the anodes. In one particular cell design, cooling water coils double as cathodes. Alternatively, the electrochemical cell can be configured such that the cell housing also functions as a cathode. This results in a particularly efficient design from both a capital cost standpoint and from an operating standpoint. The capital cost efficiency comes from the simplicity of design and from the greatly enhanced heat exchange due to the gas (hydrogen) being evolved on the heat exchange surface. The operating efficiencies come from the simplicity and ruggedness of design requiring very little maintenance.

Electrolyte

The standard electrolyte, nominally KF·2HF, is particularly useful. The composition contains approximately 41.5 to 41.9 wt % HF. Additives such as LiF can be used but are not necessary.

Anode

Referring to FIG. 1, an electrochemical cell (100) is illustrated comprising an anode assembly (19) includes a carbon anode portion (1) (hereinafter referred to as "carbon anode"), sleeve (4), compression means (5), upper flange (3), an outer gas separator (6) extending below the electrolyte surface (8), optionally, an inner gas separator (6*a*), optionally, a perforated gas separator (7), an anode hanger (2) which is connected to a source of direct current (not shown), fluorine collection outlet (14), and nitrogen inlets (13).

The outer gas separator (6) keeps the fluorine gas generated at the anodic surface and the hydrogen gas generated at the cathodic surface separated in the space in the cell above the electrolyte. The outer gas separator (6) has a flange (11) that enables the outer gas separator (6) to electrically float. In one embodiment, the outer gas separator (6) remains electrically separate from the cell housing via a pair of gaskets (10), although any techniques known to those skilled in the art to enable the outer gas separator (6) to electrically float. The outer gas separator (6) is not connected electronically to either the anode or the cathode, but rather assumes the potential of the electrolyte in which it is immersed.

The outer gas separator (6) surrounds the anode assembly (19) and its lower end is approximately midway between the carbon anode (1) cathode (9). The lower end of the outer gas separator (6) is immersed into the electrolyte (8) deep enough to prohibit hydrogen gas and the fluorine gas from mixing from pressure excursions. This depth is typically 1 to 10 cm, and preferably 2 to 5 cm. If the outer gas separator (6) is immersed too deep, cell capacity is wasted. The outer gas separator (6) is typically fabricated with a metal that will be passive in the electrochemical cell, and such metals include Monel™ nickel, and nickel alloys.

Optionally, an inner gas separator (6*a*) can also be included wherein the inner gas separator (6*a*) is positioned between the outer gas separator (6) and the anode assembly (19). The inner gas separator (6*a*) is shorter than the outer gas separator (6) and does not extend into the electrolyte (8). Because the inner gas separator (6*a*) in not immersed in the electrolyte, the material requirements are not as stringent as for the outer gas separator (6). The inner gas separator (6*a*) can be fabricated from mild steel, although Monel™ nickel or nickel alloy are preferred.

An inert gas source supplies an inert gas through inlet (12) through nitrogen inlets (13) to the annular space (designated with arrow 17) between the inner gas separator (6*a*) and the anode assembly (19), such that fluorine gas and hydrogen fluoride vapors entering the space above the electrolyte (8) are forced between the outer and inner gas separators (6 and 6*a*). The mixture of fluorine gas, nitrogen gas, and hydrogen fluoride vapors forced between the outer and inner gas separators are collected at fluorine outlet (14).

The anode hanger (2), along with the connecting sleeve (4) and circumferential compression means (5) is described below and in U.S. Ser. No. 07/736,227, which is assigned to the same assignee as the present application and is hereby incorporated by reference.

Further illustrated is an optional perforated gas separator (7), which encompasses a portion of the anode assembly (19) below the outer gas separator (6) and below the electrolyte (8) surface and provides a barrier between the bubbles of generated fluorine gas and the bubbles of generated hydrogen gas, but allows for the free flow of current from the cathode (9) to the anode assembly (19). The perforated gas separator (7) may be a separate piece from the outer gas separator (6) and held in place with a few support straps. The optional perforated gas separator (7) may extend to encompass only a fraction of the carbon anode (1) below the end of the outer gas separator (6), or it may extend to below the bottom of the carbon anode (1).

The perforations of gas separator (7) should be small enough to substantially prohibit passage of generated hydrogen through the perforations, but large enough to pass electrolytic current. Such perforations are typically 1 to 2 mm in diameters, wherein the spacing between the perforations are approximately 1 perforation radius apart. The perforations are generally uniform in size and shape. Because the perforated gas separator (7) is immersed in electrolyte (8), the material used to fabricate the perforated gas separator (7) should be resistant under the operating conditions of the electrochemical cell.

Carbon type

Preferably, carbon anode (1) is made of amorphous, nongraphitic carbon. The carbon can be a low-permeability, or high-permeability, monolithic structure, or a composite structure. Dense, low permeability carbons are particularly useful for fabricating the carbon anode of the anode assembly (19) and include YBD carbon (commercially available from UCAR Carbon Co. Inc.) and Stackpole grade 6231 carbon (commercially available from Stackpole Carbon Co.). Other examples of suitable carbons are known to those skilled in the art and include P2JA carbon (obtained from SA Utility Co.) and carbons commercially available from Toyo-Tanso Co.

Anode Configuration

Figure 2:
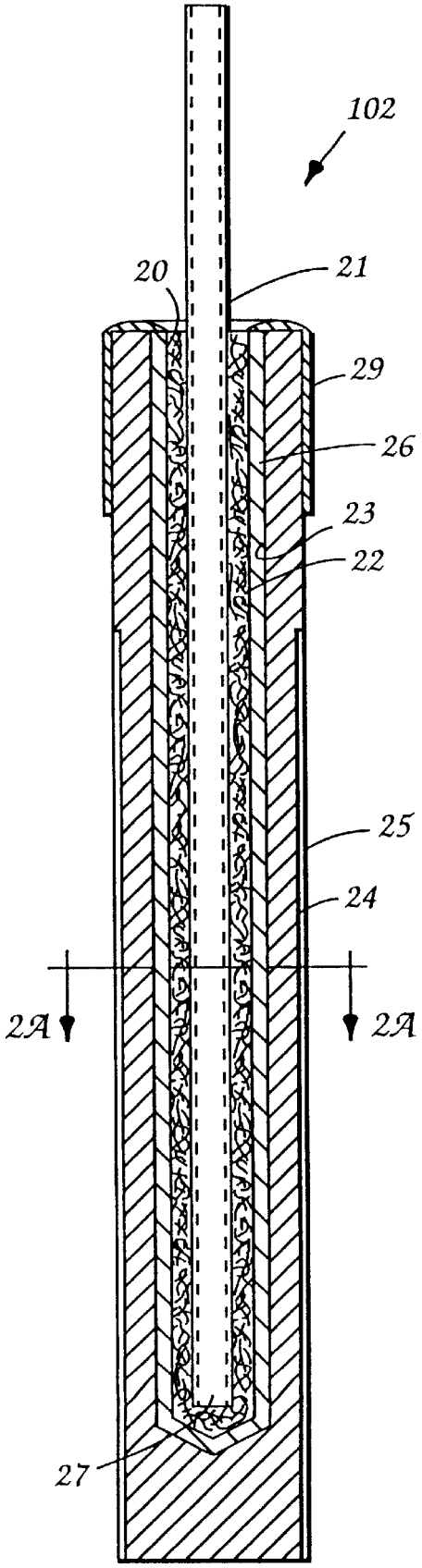
FIG. 2 is a cross-sectional view of an anode assembly.
Figure 3:
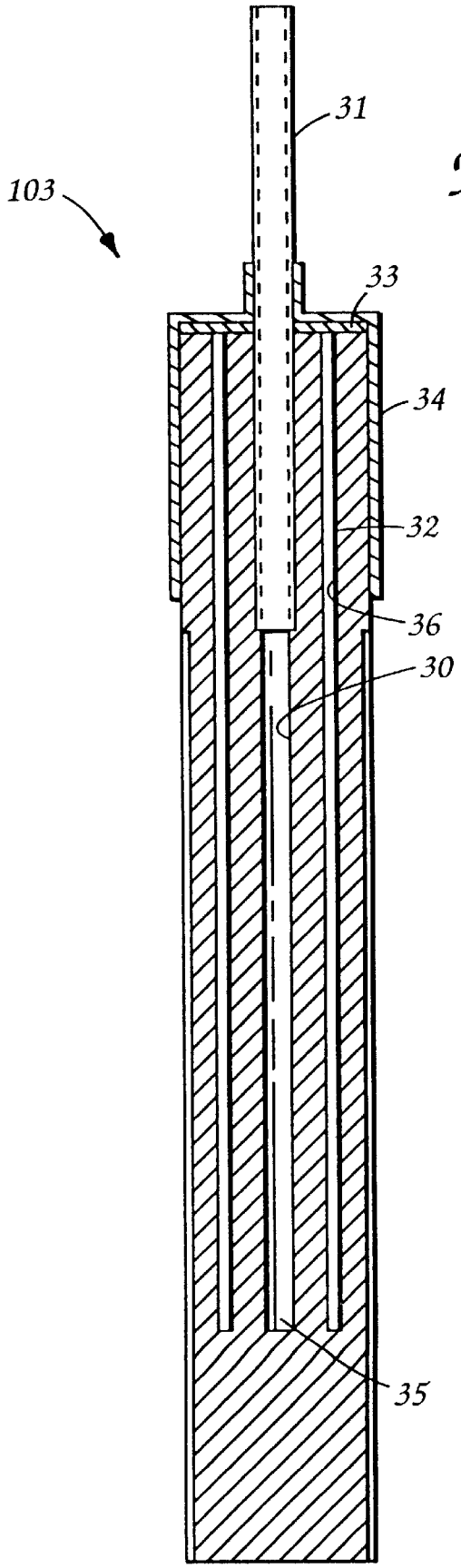
FIG. 3 is a cross-sectional views of an alternative anode assembly.

The anode configurations illustrated in FIGS. 2 and 3 can be used in anode assembly (19) and can be used in all instances where carbon anode (1) is referred to in FIG. 1. The carbon anode of the anode (102, 103) is cylindrical and has a centrally-located channel (20, 30) containing an interior metal conductor (21, 31). Typically, the length of the carbon anode (102, 103) of the anode assembly (19) ranges in size from 20 cm to approximately 120 cm long. However, the recitation of the length should in no way be construed to limit the scope of the present invention. The longer the interior metal conductor (21, 31) contained within the interior channel (20, 30), makes the current density distribution at the surface of the anode substantially uniform.

This interior channel (20, 30), and the included interior metal conductor (21, 31), extends from the top of the carbon anode (102, 103) to a point below the electrolyte level (8), and more preferably, to a point within about one carbon anode radius from the bottom of the carbon piece. Preferably, the internal channel (20, 30) runs through the carbon anode (102, 103) at least 33%, more preferably at least 50%, and most preferably at least 70%, of the carbon anode (102, 103) by length.

Advantageously, the internal metal conductor (21, 31) contained in the interior channel (20, 30) improves the conductivity of the anode assembly (19) and thus lessens resistive heating especially in the difficult to cool and particularly vulnerable area of the anode above the electrolyte (8) surface. Further, this internal metal conductor (21, 31) reduces resistive losses and improves the current density distribution at the anode surfaces.

The internal metal conductor (21, 31) may be essentially pure metals, metal alloys, or layered metals. Suitable conductive metals can include copper, nickel, gold-plated nickel, NIGOLD plated nickel, Monel™ alloy, and other non-reactive alloys, preferably the conductive metals are copper, nickel, Monel™ alloy, and other non-reactive alloys. In addition to using a conductive metal tube or rod, the internal channel (20, 30) can be metal plated on its outer surface (23).

The conductive metal plate (23) is generally distributed throughout the length of the interior channel. This distribution can be uniform throughout the length, but there may be more conductive metal at the top of the carbon anode (102, 103) where the current is greater. A sufficient quantity of the conductive metal should be included in the internal channel (20, 31) that the anode assembly (19), when used in the electrochemical cell to generate fluorine, can be run at a high current density without undue resistance heating. The distribution of conductive metal should be such that there is sufficient cross-section of metal at each point in the channel to carry the current without undue voltage loss due to resistive loss. The requisite distribution can be estimated satisfactorily using known resistivities of the various components, the currents that will be passed, and temperature constraints. Generally, a sufficient quantity of conductive metal provides a cross-sectional area of at least 1.0 $cm^2$/1000 amps and preferably, a cross-sectional area of 3.2 to 6.4 $cm^2$/1000 amps.

The conductive metal can be added to the internal channel (20), using techniques known for depositing metals onto surfaces including, for example, electroplating, electroless deposition, flame spraying or soldering or otherwise positioning a metal tube or rod into the internal channel (20), such as positioning a metal tube or rod into place loosely and soldering it into place or filling the space between the internal channel surface (26) and/or metal plating (23) and the interior channel (20) with conductive metal turnings or metal wool (22), or filling the space between it and the interior channel with conductive metal spheres, or causing the metal tube or rod to expand to make contact with the interior channel wall.

Referring to FIG. 3, in addition to the centrally-located internal conductor (31), smaller internal conductors (32) can be inserted into evenly spaced holes (36), running substantially the length of the carbon anode (103) positioned around the periphery of the centrally-located internal conductor (31), or around the periphery of the carbon anode (103) without a centrally-located internal conductor. Typically there are 3 to 6 smaller internal conductors, however, this number is dependent upon the diameter of the carbon anode (103).

Furthermore, it may be advantageous to metal plate the top of the carbon anode (103), that is, the top 10 to 15 cm of the external circumference of the carbon anode (103). Optionally, a metal disk (33) can be positioned between the top of the carbon anode (103) and the metal plating (34). This portion to be plated is where the sleeve (4, referring to FIG. 1) is clamped onto the carbon anode (103). Suitable plating metals include nickel and copper, preferably the plating metal is nickel. The thickness of the plated metal layer is approximately 0.010 to 0.03 cm electroplated onto an upper section of the carbon anode. Although electroplating is suggested as a means to provide the metal plate, it is within the scope of the present invention to use techniques known in the art for providing thin metal layers.

Polymeric material impregnation Compositions

When the internal conductor extends below 10 cm below the electrolyte surface to essentially the length of the carbon anode, the carbon anode can be partially or fully impregnated with a polymeric material. The carbon anode includes pores which if left unobstructed would allow electrolyte and fluorine to penetrate through to the internal metal conductor, causing corrosion of the metal. To alleviate this problem, the carbon anode can be impregnated with a polymerizable material that fills the pores in the carbon anode that once cured or polymerized prevents corrosive amounts of electrolyte and fluorine from reaching the internal metal conductor. Filling the pores with a polymeric material reduces the permeability of the carbon anode to electrolyte and fluorine to essentially zero. Surprisingly, the impregnated polymeric material minimizes corrosion of the internal metal/carbon junction without itself being catastrophically degraded by the fluorine generated on the anode surface, particularly in view that fluorine is known to react spontaneously with most organic materials, hydrocarbons, and hydrocarbon-based polymers. It is not necessary to impregnate all the pores in the carbon anode with the polymeric material.

The carbon anode should be impregnated to the extent the internal conductor is effectively shielded from the corrosive affects of the electrolyte and fluorine gas. Preferred polymerizable compositions are monomeric or prepolymeric materials that are essentially 100% solids and can be cured or polymerized in situ to fill and block the reticulated network of pores of the carbon anode. Other monomeric or prepolymeric materials include any materials that can be thermally cured or polymerized, or can be cured or polymerized at room temperature. Alternatively, some monomeric or prepolymeric materials may be dissolved in a solvent that can subsequently be evaporated from the carbon anode.

Useful monomeric or prepolymeric materials can be cured or polymerized methods known to those skilled in the art and such materials can be a component in a polymerizable composition that may contain initiators and/or additives that may be useful in curing or polymerizing the polymerizable composition. The initiators and/or additives are present in the polymerizable compositions in amounts effective to accomplish the known function of the additives.

Polymeric materials include for example, epoxies, styrenes and styrene-divinyl benzene copolymers. Polymeric materials that are less than essentially 100% solids may be used provided they essentially block the network of pores.

It is not necessary to impregnate the entire carbon anode with the polymeric material, but the anode preferably includes sufficient polymeric material that no significant corrosion of the internal metal conductor occurs when the carbon anode is used under normal operating conditions for at least six months.

Methods for impregnating carbon anode

The polymerizable composition is preferably in an essentially 100% solids liquid state or in solution. Preferably, the viscosity is low enough to permit the polymerizable composition to flow into and fill the pores of the carbon anode. When the viscosity is high, that is, the polymerizable composition is viscous, the carbon anode can be impregnated with the polymerizable composition using a vacuum impregnation process as discussed below.

Generally, the carbon anode can be impregnated by either introducing a polymerizable composition into the carbon anode through the centrally disposed internal channel or by allowing the monomeric or prepolymeric material to absorb into carbon anode from the outside-in. Viscosity of the polymerizable mixture will generally dictate the method used for impregnating the carbon anode.

To impregnate a carbon anode by introducing the polymerizable composition into the centrally disposed internal channel, the polymerizable composition can be poured into the channel and then allowed to soak into the carbon anode for a period of time. At the end of the soaking period, the polymerizable composition is thermally polymerized by heating the carbon anode. The length of the soaking period, is a time period sufficiently long to permit the polmerizable composition to "appear" on the outside surface of the carbon anode. The length of the soaking period is dependent on the initial viscosity of the polymerizable composition, porosity of the carbon anode and the physical size of the carbon anode.

An alternative method is to impregnate the carbon anode from the outside-in. The polymerizable mixture can be prepared, allowed to "soak" into the carbon anode for a period of time (typically 24 hours or more), and thermally polymerized. Once polymerization has occurred, it is advantageous to remove the excess polymer from the carbon anode and treated the carbon anode to remove excess unreacted monomer, for example, by subjecting the carbon anode to a vacuum.

The technique of vacuum impregnation may also be used advantageously to put the polymerizable mixture in place. In one embodiment of this technique, the carbon anode is cast as a hollow cylinder closed at one end and such a piece might be 120 cm in length and 20 cm in outside diameter, with a single centrally located internal channel having a diameter of 10 cm and extending into the carbon piece for 110 cm. A suitably sized internal metal conductor, say of copper, is placed in the internal channel by electrolytic plating as stated above. External plating, as appropriate might also be done at this time. The assembly is then placed in a vacuum chamber and evacuated to a vacuum of 1 Torr or less. Then a degassed polymerizable composition is allowed to run in and fill the reticulated network of pores. Excess polymerizable material is then drained off and the remaining mixture is polymerized in situ. The assembly is then machine finished as desired including final shaping to dimension and machining of surface grooves. One advantage of this technique is that the reticulated network of pores can be rapidly and efficiently filled. Another advantage is that only final surface machining is required. Yet another advantage is that by plating the carbon before impregnation, the electrical contact between the metal and the carbon is improved.

Grooves

Figure 2A:
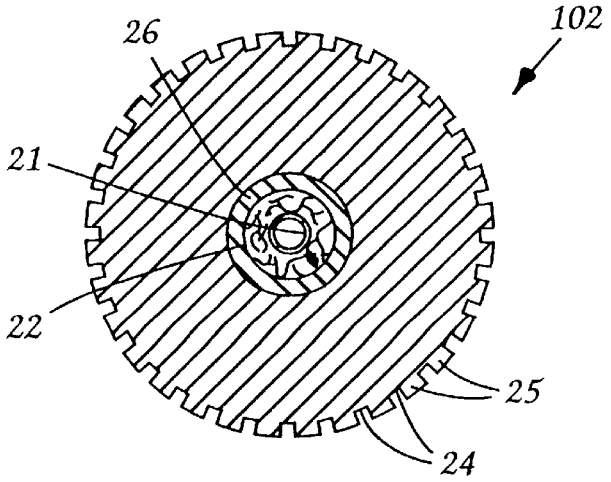

Referring to FIG. 2A, the carbon anode (102) can have a plurality of parallel, substantially vertical grooves (24) disposed on the outer surface (25) that facilitate the flow and collection of the fluorine gas generated at the anode. The grooves (24) increase the time between anode polarization and enables practical operation at high current densities. The grooves (24) essentially prevent the anode surface from being "blinded" by lenticular bubbles of generated fluorine. The grooves (24) are described in more detail in U.S. Ser. No. 07/736,227, filed Jul. 26, 1991, now abandoned which was previously incorporated by reference herein.

Purge $N_2$

Optionally, an internal, nitrogen purge to each anode can be provided to exclude corrosive fluorine and electrolyte from contacting the internal conductor. If a nitrogen purge is used, the pressure of the nitrogen gas is such the nitrogen will flow into the centrally-located internal channel and out through the carbon anode into the space between the inner and outer gas separators **(6, 6*a*)**.

Sleeve

Again referring to FIG. 1, metal sleeve (4) encircling adjacent portions of the hanger (2) and the carbon anode (1) in combination with a means for uniformly applying a circumferential compression (5) to the sleeve comprise the current carrier (4,5). The carbon anode (1) preferably has a portion that is contiguously positioned next to and axially aligned with a corresponding portion of the hanger (2). The sleeve (4), compression means (5) and the hanger (2) provide mechanical, as well as electrical continuity between the carbon anode (1) and a source of direct current (not shown). The sleeve (4) can be fabricated from materials that are conductive and are not reactive to the corrosive atmosphere within an electrochemical cell under operating conditions. Such materials include nickel, gold-plated nickel, Monel™ nickel alloy. Other examples are described in U.S. Ser. No. 07/736,227 and such description is incorporated herein by reference.

Hanger

Hanger (2) and flange (3) provide mechanical support and permits postioning of the electrode within the electrochemical cell. Furthermore, hanger (2) conducts current to the carbon anode (1). The hanger (2) and flange (3) can be fabricated from ordinary mild steel, nickel, Monel™ nickel alloy, or other suitable materials. Other examples of the hanger (2) and flange (3) are described in U.S. Ser. No. 07/736,227 and such description is incorporated herein by reference.

Objects and advantages of this invention are further illustrated by the following examples, but the particular materials and amounts thereof recited in these examples, as well as other conditions and details, should not be construed to unduly limit this invention. All materials are commercially available or known to those skilled in the art unless otherwise stated or apparent.

EXAMPLES

Example 1

Referring to the Figures, an example of a preferred anode assembly (19) was 32.4 cm in length, about 3.5 cm in diameter, and included a central channel (20), that was 24.5 cm in length. Channel (20) had a diameter of 1.19 cm. The outer surface (25) of most of the anode (27.3 cm portion) included 27 equally-spaced vertical grooves (24) that were approximately 0.030 cm wide and 0.20 cm deep. The inner surface (23) of channel (20) included an electroplated conductive layer (26) consisting of a 0.069 cm thick layer of nickel covered by a 0.21 cm thick layer of copper. A 0.953 cm diameter copper tube (21) was inserted into channel (20) and extended almost to the bottom (27)of the channel. Copper wool packing (22) was used to hold the copper tube (21) in place. The end of the copper tube (27) extending from the channel (20) was connected to a current source (not shown) and a nitrogen source (not shown). The portion of the carbon piece (102) that contacted the sleeve (4) and hanger (2) was coated with a 0.068 cm thick layer of nickel (26). This layer (26) improved the electrical contact between the carbon anode (102) and the sleeve/hanger (4, 2).

An epoxy resin was prepared by blending 100 parts by weight ARALDITE PY 306 (commercially available from Ciba Geigy), 85 parts by weight HY917 hardener (commercially available from Ciba Geigy), and 1 part by weight DY070 catalyst (commercially available from Ciba Geigy). With the carbon anode of the anode held vertically, the epoxy resin was poured into channel (20). Optionally, a piece of tubing and rubber stopper may be inserted into the channel.(20) to generate more hydrostatic pressure and force the epoxy resin further into the pores of the carbon anode (102). Periodically, additional epoxy resin was added to channel (20) to maintain the level as epoxy resin soaked into the pores of the carbon anode (102).

Once the epoxy resin had soaked sufficiently into the pores of the carbon anode (102), after six to eight hours, the anode was placed in an oven and cured at 100° C. overnight. After the epoxy resin had cured, channel (20) was redrilled to the desired diameter.

The anode was used in the electrochemical cell illustrated in FIG. 1. When assembled, the anode assembly was immersed to a depth of approximately 26.5 cm in KF·2HF electrolyte (8) with about 23 cm exposed below the outer gas separator (6). The cell was operated at 90° C. The cell was started up by ramping from 10 amperes (amps) to 100 amps over 24 hours. As fluorine gas was generated at the anode, it passed between outer gas separator (6) and the anode surface. The fluorine gas, after exiting the electrolyte, was carried by nitrogen entering through inlets (13) out of the cell through fluorine collection outlet (14). Generated hydrogen gas was vented out through outlet (16). Hydrogen fluoride was fed into the cell on demand to replenish the electrolyte as fluorine was generated. The electrode ran for 8 months at 100 amps. The average cell voltage drop over this time period was approximately 9.2 volts. The anode area directly opposite the cathode was 250 $cm^2$, which means the current density at 100 amps was 400 $mA/cm^2$.

Example 2

The anode like the one described in Example 1 was impregnated with a styrene-divinyl benzene polymeric material instead of an epoxy.

A monomer mixture was prepared that included a 4:1 ratio of styrene:divinyl benzene. The mixture was filtered with silica gel to remove inhibitor, and 0.5%–1% by weight VAS064 initiator (commercially available from Dupont) was added. The carbon anode was placed in a glass vessel. The monomer mixture was also poured into the vessel and allowed to soak into the carbon anode for at least a day. The anode and vessel were then heated at 40° C. overnight to initiate polymerization, and then at 100° C. for an additional day to complete polymerization. After cooling, the vessel was removed and the anode placed under vacuum to remove unreacted monomer and odor. The anode was then machined to final shape, taking care to remove all excess polymer from the anode surface. The centrally-located internal channel was drilled and the conductor applied as in Example 1.

The anode was placed in an electrochemical cell in the same manner as in Example 1 and was run for 8 months at 100 amps. The average cell voltage drop over the time period averaged 9.5 volts.

Example 3

Referring to FIG. 3, an alternative carbon anode is illustrated, wherein the carbon anode (103) (32.4 cm in length) includes a 25.4 cm long central channel (30) having a diameter of 0.95 cm to a depth of 5.08 cm and a diameter of 0.635 cm for the remainder of the channel (30). Four additional 0.397 cm diameter channels (36) (25.4 cm in length; two shown) are spaced equally in the anode approximately 0.71 cm from the center of the anode. The anode exterior (the lower 27.3 cms) has the same groove pattern as the anode illustrated in FIG. 2A. A 0.95 cm diameter copper tube (31) inserted into the upper 5.08 cm of channel (30), and 0.397 diameter copper conductor rods (32) are inserted into channels (36) (full length) and soldered into place. Copper tube (31) is connected to a nitrogen source. The top surface of the anode also included a 0.158 cm thick copper disk (33) soldered into place, with a 0.018 cm thick nickel coating (34) over the top of the copper disk (33) and down the outside about 3.8 cm, to improve the electrical contact between the sleeve/hanger (4, 2) and the anode. The anode is impregnated with a styrene-divinyl benzene polymer using the procedure described in Example 2.

The anode was assembled in the electrochemical cell illustrated in FIG. 1 under the same general operating parameters, except that a nitrogen gas flow sufficient to maintain a pressure drop of 0.07 bar (3 psi) was maintained through copper tube (31). The anode was run for a period of 6 months at 100 amps. The cell voltage drop over this period averaged 9.7 volts.

Example 4

Referring to FIG. 1, another embodiment of anode assembly (19) was constructed including the optional inner gas separator (6*a*) between the combination of the hanger (2), sleeve (4) and compression means (5), and the carbon anode (1) (also referred to as "combination of elements"); and outer gas separator (6). Inner gas separator (6*a*) did not extend to the electrolyte and and like outer gas separator (6) was composed of an inert material like Monel™ alloy. Nitrogen gas entered the space between inner gas separator (6*a*) and the combination of elements through nitrogen inlets (13). The nitrogen traveled down through this space (desginated by the arrows 17) into the area below inner gas separator (6*a*). The nitrogen flow diluted the fluorine gas and hydrogen fluoride vapors rising from the electrolyte and carried them up through the space (designated with the arrows 18) between inner gas separator (6*a*) and outer gas separator (6). The nitrogen gas, fluorine gas, and hydrogen fluoride vapors blend exited the cell (100) through collection outlet (14).

An advantage to this assembly is that fluorine gas and hydrogen fluoride vapors were kept away from the junction between the carbon anode (1) and the sleeve (4) and hanger (2), resulting in less corrosion of the junction area.

Comparative Example C5

An anode assembly was fabricated using the same elements as in Examples 1–4 except, the carbon anode was as described below. A carbon anode 32.4 cm in length and about 3.5 cm in diameter included a centrally located internal channel (25.4 cm in length and 1.90 cm in diameter). A conductive layer of copper 0.0814 cm thick was electroplated onto the surface of the internal channel. A 0.95 cm diameter copper tube was inserted in the plated internal channel and soldered into the top of the channel and extended out of the top of the combination of elements to serve as a conduit for a purge flow of nitrogen and as a first electrical junction with the carbon anode. A 0.75 cm hole was drilled through the copper plating at the bottom of the internal channel to allow the nitrogen gas to flow out of the channel through the carbon anode. A layer of copper (0.013 cm thick) was plated over the top of the carbon anode and continued down the sides for approximately 5 cm and served as an electrical junction between the carbon anode and the sleeve. The lower 27.3 cm of the outer surface of the carbon anode included the same 27 equally spaced vertical grooves (see FIG. 2*a*), 0.030 cm wide and 0.20 cm deep, and machined into the carbon anode as described in Example 1.

The anode assembly was placed in an electrochemical cell in the same manner as in Example 1 and was run for 51 days at 100 amps. On the 51st day, the carbon anode fractured into pieces due to corrosion of the internal copper conductor.

Comparative Example C6

An anode assembly was fabricated using the same elements as in Examples 1–4 except, the carbon anode was as described below. A carbon anode was prepared that was 32.4 cm in length and about 3.5 cm in diameter. The lower 27.3 cm of the outer surface of the carbon anode included the same 27 equally spaced vertical grooves (see FIG. 2*a*), 0.030 cm wide and 0.20 cm deep, and machined into the carbon anode as described in Example 1. There was no internal metal conductor installed in the carbon anode of the anode assembly.

The anode assembly was placed in an electrochemical cell in the same manner as in Example 1 and was run for 46 days at 53.6 amps. The current was then raised to 80 amples for 132 hours. Cell operation appeared satisfactory.

Finally, the cell current was raised to 100 amps. After 56 hours of operation, the anode assembly failed because the area just above the electrolyte level was burned. Heat generation in the cell was so intense, the Kel-F lid of the cell was partially melted. The section of the carbon anode that had been below the electrolyte was undamaged. The section of the carbon anode above the electrolyte was partially burned through and broken at the narrowed section.

Various modifications and alterations of this invention will become apparent to those skilled in the art without departing from the scope and principles of this invention, and it should be understood that this invention is not to be unduly limited to the illustrative embodiments set forth herein above. All publications and patents are herein incorporated by reference to the same extent as if each individual publication or patent was specifically and individually indicated to be incorporated by reference.

What is claimed:

1. An electrochemical cell for the production of fluorine, comprising:

(1) a cell housing;

(2) a KF·2HF electrolyte;

(3) a cathode, in contact with the electrolyte, at which hydrogen gas is generated;

(4) an anode assembly comprising:

(a) a carbon anode, in contact with the electrolyte, at which fluorine gas is generated;

(b) an internal metal conductor, positioned in a centrally located internal channel, wherein the internal metal conductor is not in contact with the electrolyte and extends from the top of the carbon anode to below the electrolyte;

(c) an outer gas separator positioned equidistant between the anode assembly and the cathode; and (d) an anode hanger abutted to the carbon anode; mechanically and electrically connected to the carbon anode using a sleeve and compression means to hold the sleeve, anode hanger and carbon anode in alignment;

(5) a means for supplying current to the cathode and the anode; and (6) means for removing the generated fluorine gas and a means for removing the generated hydrogen gas.

2. The electrochemical cell according to claim 1, wherein the internal conductor extends from the top of the carbon anode to substantially the bottom of the carbon anode.

3. The electrochemical cell according to claim 2, wherein the internal metal conductor comprises a layer of a metal plated onto the surface of the centrally located internal channel.

4. The electrochemical cell according to claim 3, further comprises several small metal conductors inserted into evenly spaced holes, running substantially the length of the carbon anode, and the holes are positioned internally around the periphery of the carbon anode.

5. The electrochemical cell according to claim 2, wherein the internal metal conductor comprises a metal rod or tube positioned in the centrally located internal channel.

6. The electrochemical cell according to claim 1, wherein the anode assembly further comprises a perforated gas separator positioned below the bottom of the outer gas separator and immersed in the electrolyte.

7. The electrochemical cell according to claim 1, wherein the carbon anode further comprises polymeric material partially or fully impregnated in the carbon anode.

8. The electrochemical cell according to claim 7, wherein the polymeric material comprises an epoxy resin, a styrene polymer or a styrene-divinyl benzene copolymer.

9. The electrochemical cell according to claim 1, wherein the internal metal conductor comprises essentially pure metals, alloys, composites or layered metals.

10. The electrochemical cell according to claim 1, wherein the electrochemical cell configuration is a callandria cell.

11. The electrochemical cell according to claim 1, wherein the anode further comprises a plurality of parallel, substantially vertical grooves disposed on the outside surface of the carbon anode, around the circumference of the carbon anode.

12. An anode for use in an electrochemical cell for the generation of fluorine from a KF·2HF electrolyte, the anode comprising a carbon anode partially or fully impregnated with a polymeric material, and a conductive metal located in a centrally disposed internal channel inside the carbon anode that extends from the top of the anode to at least the level of the electrolyte surface when the anode is positioned in an electrolyte in an electrochemical cell.

13. The anode according to claim 12, wherein the internal conductor comprises a layer of metal plated onto the surface of the internal channel.

14. The anode according to claim 13, wherein the internal conductor comprises a metal rod positioned in the internal channel.

15. The anode cell according to claim 13, further comprises several metal conductor inserted into evenly spaced holes, running substantially the length of the carbon anode, and the holes are positioned internal around the periphery of the carbon anode.

16. The anode according to claim 13, wherein the polymeric material comprises an epoxy resin, a styrene polymer or a styrene-divinyl benzene copolymer.

17. The anode according to claim 13, wherein the anode further comprises a plurality of parallel, substantially vertical grooves disposed on the outer surface and around the circumference of the anode.

18. The anode according to claim 12, wherein the anode is cylindrical in shape.

19. An electrochemical cell for the production of fluorine, comprising:

(1) a cell housing;

(2) KF·2HF electrolyte;

(3) a cathode, in contact with the electrolyte, at which hydrogen gas is generated;

(4) an anode having a carbon anode, in contact with the electrolyte, at which fluorine gas is generated;

(5) a sleeve, compression means, and holder to mechanically support the carbon anode and electrically contact with the carbon anode;

(6) an outer gas separator that maintains a separation in the cell, in the space above the electrolyte, between the hydrogen generated at the cathode and the fluorine generated at the anode;

(7) an inner gas separator positioned between the upper portion of the anode assembly and the outer gas separator;

(8) a perforated gas separator positioned at the bottom of the outer gas separator and immersed in the electrolyte;

(9) at least one inert gas inlet between the inner gas separator and the upper portion of the anode assembly;

(10) a fluorine gas outlet through which passes a mixture of the inert gas, the generated fluorine gas and hydrogen fluoride vapors arising from the electrolyte when the electrochemical cell is in operation; and

(11) a hydrogen gas outlet through which passes the generated hydrogen gas and hydrogen fluoride vapors arising from the electrolyte.

20. The electrochemical cell according to claim 19, wherein the electrochemical cell configuration is a callandria cell.

* * * * *

UNITED STATES PATENT AND TRADEMARK OFFICE

CERTIFICATE OF CORRECTION

PATENT NO. : 6,146,506
DATED : November 14, 2000
INVENTOR(S) : Gerald L. Bauer et al.

It is certified that error appears in the above-identified patent and that said Letters Patent is hereby corrected as shown below:

Column 4,
Line 64, after "MONEL™", insert -- corrosion resistant alloys of predominately nickel and copper and a very small percentage of carbon, manganese, iron, sulfur and silicon --.

Column 7,
Line 23, after "NIGOLD" insert -- a metal having a thin hardened gold plate thereof --.

Column 11,
Line 23, "channel.(20)" should read -- channel (20) --.

Signed and Sealed this

Second Day of July, 2002

*Attest:*

*Attesting Officer*

JAMES E. ROGAN
*Director of the United States Patent and Trademark Office*